US010428523B2

(12) United States Patent
Sorkin

(10) Patent No.: US 10,428,523 B2
(45) **Date of Patent: *Oct. 1, 2019**

(54) SHEATHING LOCK END CAP

(71) Applicant: Felix Sorkin, Stafford, TX (US)

(72) Inventor: Felix Sorkin, Stafford, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/172,365

(22) Filed: Oct. 26, 2018

(65) Prior Publication Data

US 2019/0063066 A1 Feb. 28, 2019

Related U.S. Application Data

(63) Continuation of application No. 15/226,594, filed on Aug. 2, 2016, now Pat. No. 10,145,114.

(60) Provisional application No. 62/200,975, filed on Aug. 4, 2015.

(51) Int. Cl.

| | |
|---|---|
| ***E04C 5/12*** | (2006.01) |
| ***E04G 21/12*** | (2006.01) |
| *E04C 5/10* | (2006.01) |

(52) U.S. Cl.

CPC ..... *E04C 5/122* (2013.01); *E04G 21/12* (2013.01); *E04C 5/10* (2013.01)

(58) Field of Classification Search

CPC ..... E04C 5/122; E04C 5/125; E04C 5/127

See application file for complete search history.

(56) References Cited

U.S. PATENT DOCUMENTS

| | | | | |
|---|---|---|---|---|
| 4,773,198 | A * | 9/1988 | Reinhardt | E04C 5/122 52/223.13 |
| 5,630,301 | A * | 5/1997 | Sieg | E04C 5/122 24/115 M |
| 6,023,894 | A * | 2/2000 | Sorkin | E04C 5/122 24/122.6 |
| 6,381,912 | B1 * | 5/2002 | Sorkin | E04C 5/08 24/459 |
| 6,761,002 | B1 * | 7/2004 | Sorkin | E04C 5/12 403/374.1 |
| 7,793,473 | B2 * | 9/2010 | Sorkin | E04C 5/10 24/122.6 |
| 7,823,345 | B1 * | 11/2010 | Sorkin | E04C 5/122 24/122.3 |
| 9,097,014 | B1 * | 8/2015 | Sorkin | E04C 5/122 |

(Continued)

*Primary Examiner* — Babajide A Demuren

(74) *Attorney, Agent, or Firm* — Adolph Locklar

(57) ABSTRACT

A post-tensioning tendon may include a tension member including a strand and sheath, the sheath having an outer surface. The post-tensioning tendon may also include an anchor coupled to an end of the tension member, the anchor including a tubular extension through which the tension member is passed. The tubular extension may have an engaging surface. The post-tensioning tendon may additionally include a sheathing retention assembly. The sheathing retention assembly may include an outer cap, the outer cap having a forcing surface. The outer cap may be coupled to the tubular extension. The sheathing retention assembly also may include one or more holding elements positioned at least partially within the outer cap. The one or more holding elements may each have a tapered outer surface abutting the forcing surface. The one or more holding elements each may include an inner surface that engages the outer surface of the sheath.

24 Claims, 7 Drawing Sheets

(56) References Cited

U.S. PATENT DOCUMENTS

| | | | | |
|---|---|---|---|---|
| 2002/0007604 | A1* | 1/2002 | Wallstein | E04C 5/122<br>52/223.13 |
| 2008/0302035 | A1* | 12/2008 | Shin | E02D 5/765<br>52/223.13 |
| 2015/0300021 | A1* | 10/2015 | Hayes | B28B 23/046<br>33/700 |
| 2015/0330078 | A1* | 11/2015 | Sorkin | E04B 1/66<br>52/223.13 |

* cited by examiner

SHEATHING LOCK END CAP

CROSS-REFERENCE TO RELATED APPLICATIONS

This application is a continuation application which claims priority from U.S. utility application Ser. No. 15/226,594, filed Aug. 2, 2016, which is itself an nonprovisional application that claims priority from U.S. provisional application No. 62/200,975, filed Aug. 4, 2015, each of which is hereby incorporated by reference in its entirety.

TECHNICAL FIELD/FIELD OF THE DISCLOSURE

The present disclosure relates generally to post-tensioned, prestressed concrete construction. The present disclosure relates specifically to anchors for use therein.

BACKGROUND OF THE DISCLOSURE

Many structures are built using concrete, including, for instance, buildings, parking structures, apartments, condominiums, hotels, mixed-use structures, casinos, hospitals, medical buildings, government buildings, research/academic institutions, industrial buildings, malls, roads, bridges, pavement, tanks, reservoirs, silos, sports courts, and other structures.

Prestressed concrete is structural concrete in which internal stresses are introduced to reduce potential tensile stresses in the concrete resulting from applied loads; prestressing may be accomplished by post-tensioned prestressing or pre-tensioned prestressing. In post-tensioned prestressing, a tension member is tensioned after the concrete has attained a desired strength by use of a post-tensioning tendon. The post-tensioning tendon may include for example and without limitation, anchor assemblies, the tension member, and sheathes. Traditionally, a tension member is constructed of a material that can be elongated and may be a single or a multi-strand cable. Typically, the tension member may be formed from a metal or composite material, such as reinforced steel. The post-tensioning tendon conventionally includes an anchor assembly at each end. The post-tensioning tendon is fixedly coupled to a fixed anchor assembly positioned at one end of the post-tensioning tendon, the "fixed-end", and stressed at the stressed anchor assembly positioned at the opposite end of the post-tensioning tendon, the "stressing-end" of the post-tensioning tendon.

Post-tension members are conventionally formed from a strand and a sheath. The strand is conventionally formed as a single or multi-strand metal cable. The strand is conventionally encapsulated within a polymeric sheath extruded thereabout to, for example, prevent or retard corrosion of the metal strand by protecting the metal strand from exposure to corrosive or reactive fluids. Likewise, the sheath may prevent or retard concrete from bonding to the strand and preventing or restricting movement of the sheath during post-tensioning. The sheath may be filled with grease to further limit the exposure of the metal strand and allow for increased mobility. Because the metal strand and the polymeric sheath are formed from different materials, the thermal expansion and contraction rates of the metal strand and polymeric sheath may differ. During conventional manufacturing, the sheaths are formed by hot extrusion over the metal strand. When the tension members are coiled for transport and storage, uneven thermal contraction may occur as the tendon cools. When installed as a post-tensioning tendon in a prestressed concrete member, cooling of the sheath may cause separation of the sheath from an anchorage, potentially exposing the metal strand to corrosive or reactive fluids.

SUMMARY

The present disclosure also provides for a post-tensioning tendon. The post-tensioning tendon includes a tension member including a strand and sheath, the sheath having an outer surface. The post-tensioning tendon also includes an anchor coupled to an end of the tension member, the anchor including a tubular extension through which the tension member is passed. The tubular extension has an engaging surface. The post-tensioning tendon additionally includes a sheathing retention assembly. The sheathing retention assembly includes an outer cap, the outer cap having a forcing surface. The outer cap is coupled to the tubular extension. The sheathing retention assembly also includes one or more holding elements positioned at least partially within the outer cap. The one or more holding elements each have a tapered outer surface abutting the forcing surface. The one or more holding elements each includes an inner surface that engages the outer surface of the sheath.

The present disclosure also provides for a method of coupling a tension member to an anchor for forming a post-tensioning tendon. The method includes providing the tension member, the tension member including a strand and a sheath. The sheath has an outer surface. The method also includes providing the anchor, the anchor including a tubular extension and positioning a sheathing retention assembly about an end of the tension member. The sheathing retention assembly includes an outer cap, the outer cap having a forcing surface and one or more holding elements positioned at least partially within the outer cap. The one or more holding elements each have a tapered outer surface abutting the forcing surface. The one or more holding elements each include an inner surface that engages the outer surface of the sheath. The method also includes passing the end of the tension member through the tubular extension of the anchor and coupling the outer cap to the tubular extension.

The present disclosure additionally provides for a method of coupling a tension member to an anchor for forming a post-tensioning tendon. The method includes providing the tension member, the tension member including a strand and a sheath, and providing the anchor. The method also includes positioning an outer cap about a tubular extension in a non-actuated position, the outer cap having a forcing surface. Further, the method includes coupling the outer cap to the tubular extension, thereby moving the outer cap to an actuated position and positioning one or more holding elements at least partially within the outer cap. The one or more holding elements each have a tapered outer surface abutting the forcing surface. The one or more holding elements each include an inner surface that engages the outer surface of the sheath. The method also includes passing the end of the tension member through the tubular extension of the anchor and coupling the outer cap to the tubular extension.

The present disclosure provides for a post-tensioning tendon. The post-tensioning tendon includes a tension member including a strand and sheath, the sheath having an outer surface. The tension member also includes an anchor coupled to an end of the tension member. The anchor includes a tubular extension through which the tension member is passed. The tubular extension has an engaging surface. The post-tensioning tendon also includes a sheathing retention assembly. The sheathing retention assembly includes an outer cap, the outer cap having a forcing surface. The outer cap is coupled to the tubular extension. The sheathing retention assembly also includes one or more holding elements positioned at least partially within the outer cap, the one or more holding elements each having an outer surface abutting the forcing surface. The outer surface of the one or more holding elements is not tapered. The one or more holding elements each includes an inner surface that engages the outer surface of the sheath.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
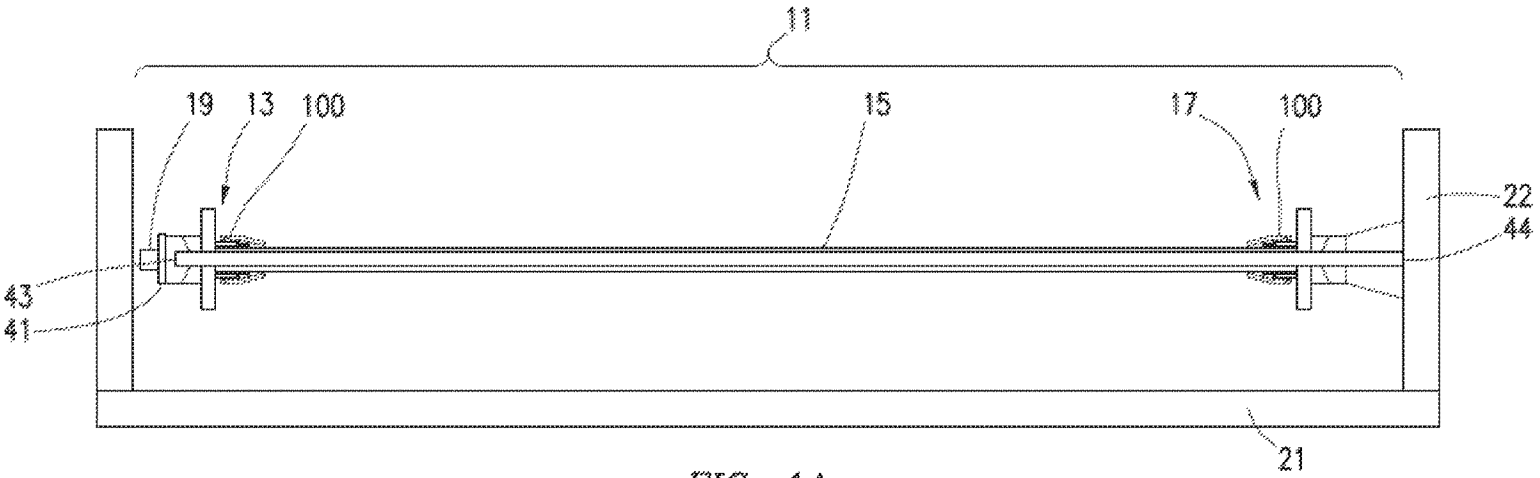
FIGS. 1A, 1B depict a partial cross section of a post-tensioning tendon within a concrete form during stages of a concrete pouring procedure consistent with embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Figure 1B:
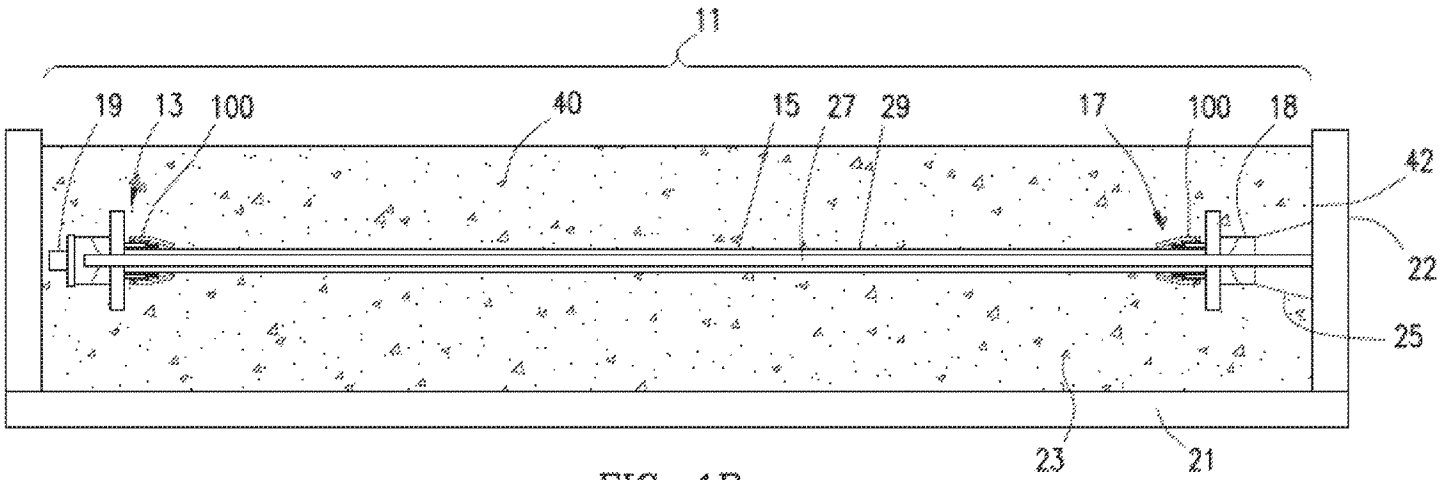
Figure 2A:
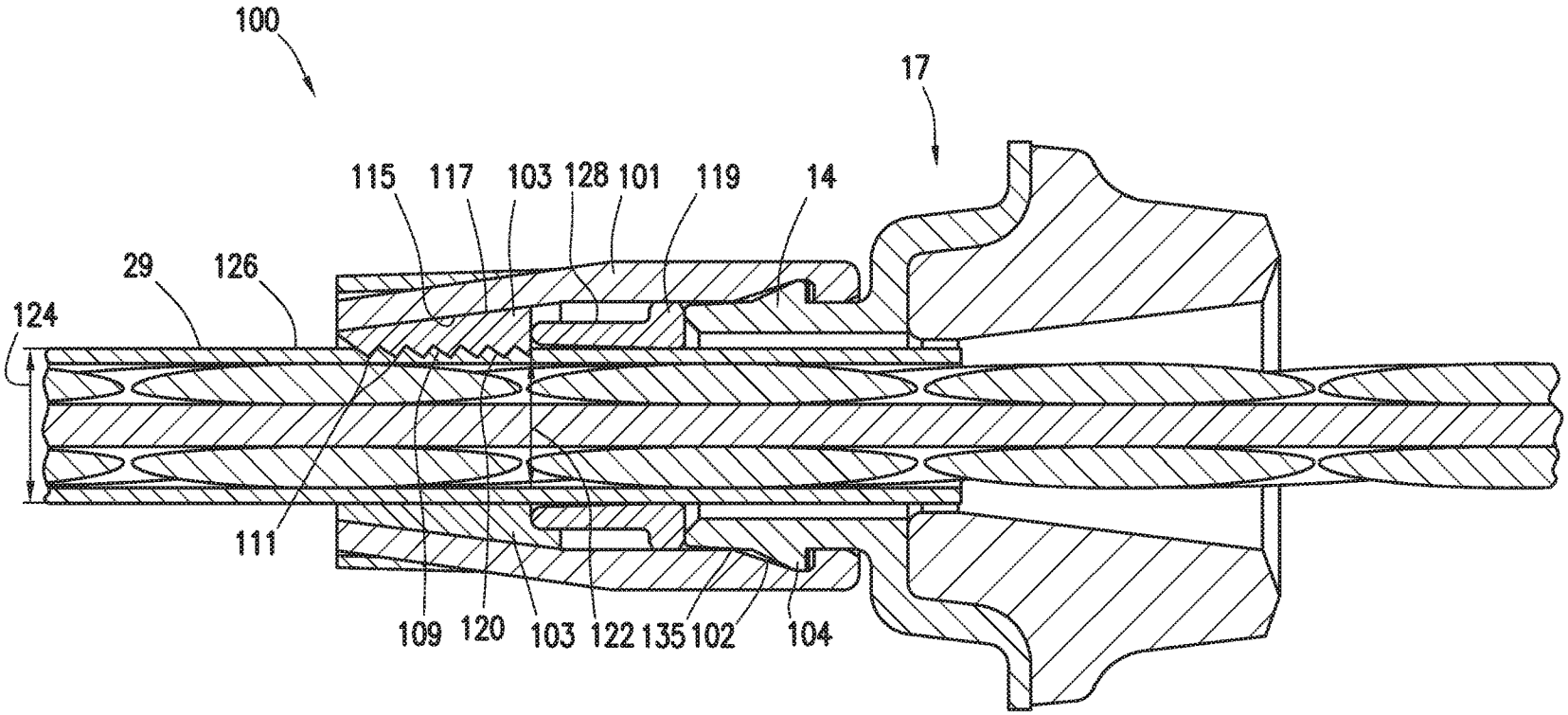
FIG. 2A depicts a cross section view of a stressing end anchor for a post tensioned concrete member including a sheathing retention assembly consistent with at least one embodiment of the present disclosure.

When stressing concrete member 40, anchoring systems may be provided to hold the tension member before and after stressing. In some embodiments, as depicted in FIGS. 1A, 1B, post-tensioning tendon 11 may be positioned within concrete form 21. Concrete form 21 is a form into which concrete may be poured to form concrete member 40. Post-tensioning tendon 11 may include for example and without limitation fixed end anchor 13, tension member 15, and stressing end anchor 17. As best depicted in FIG. 2A, in some embodiments, each anchor 13 may include a tubular extension 14. Fixed-end anchor 13 may be positioned within concrete form 21 such that fixed-end anchor 13 will be encased in concrete 23 after concrete is poured into concrete form 21. In some embodiments, fixed end cap 19 may be positioned at distal end 41 of fixed end 13. Fixed end cap 19 may, in certain embodiments, protect tension member 15 from corrosion after concrete 23 is poured by preventing or retarding corrosive or reactive fluids or concrete from contacting tension member 15.

Stressing end anchor 17 may be positioned within concrete form 21 such that it is substantially surrounded by concrete 23. Pocket former 25 may be positioned between stressing end anchor body 18 and end wall 22 of concrete form 21. Pocket former 25 may be adapted to, for example and without limitation, prevent or restrict concrete 23 from filling the space between stressing end anchor body 18 and end wall 22, thus forming a cavity or pocket in edge 42 of concrete member 40 formed by concrete 23 within concrete form 21. Pocket former 25 may thus allow access to tension member 15 from outside concrete member 40 once concrete member 40 is sufficiently hardened and end wall 22 is removed.

In some embodiments, tension member 15 may include strand 27 and sheath 29. Strand 27 may be a single or multi-strand metal cable. Sheath 29 may be tubular or generally tubular and may be positioned about strand 27. In some embodiments, space between strand 27 and sheath 29 may be filled or partially filled with a filler such as grease. When installing tension member 15, in some embodiments, a length of sheath 29 may be removed from first end 43 of tension member 15, exposing strand 27. Strand 27 may be inserted through fixed end anchor 13 until sheath 29 engages with sheathing retention capsule 100. Strand 27 may then be coupled to fixed end anchor 13 such as by the use of wedges. Tension member 15 may be positioned within concrete form 21 and tension member 15 may be cut to correspond with the length of concrete form 21. In some embodiments, a length of sheath 29 may be removed from second end 44 of tension member 15, exposing strand 27. Strand 27 may be inserted through stressing end anchor 17 until sheath 29 engages with sheathing retention capsule 100 within stressing end anchor 17.

Figure 2B:
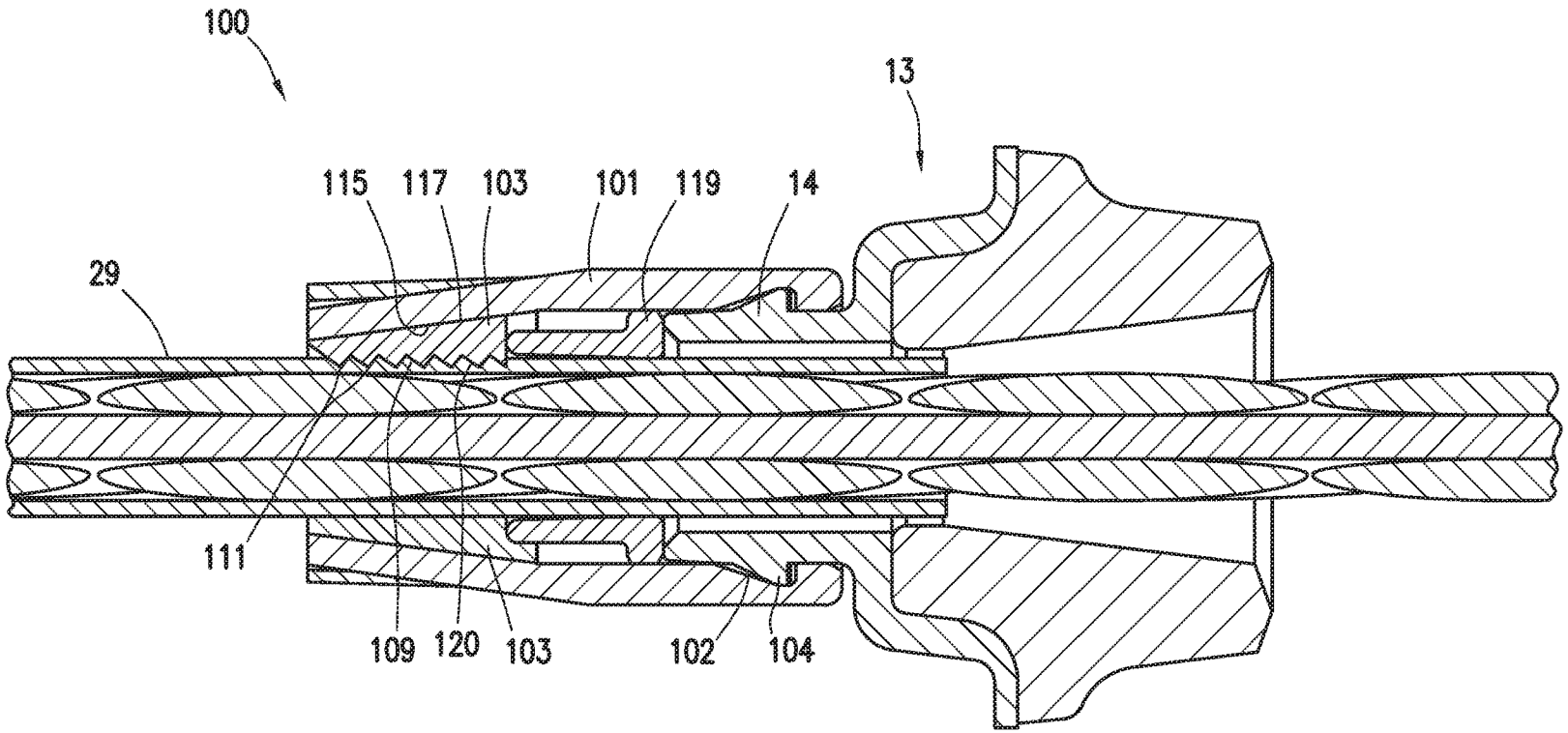
FIG. 2B depicts a cross section view of a fixed end anchor for a post tensioned concrete member including a sheathing retention assembly consistent with at least one embodiment of the present disclosure.
Figure 5A:
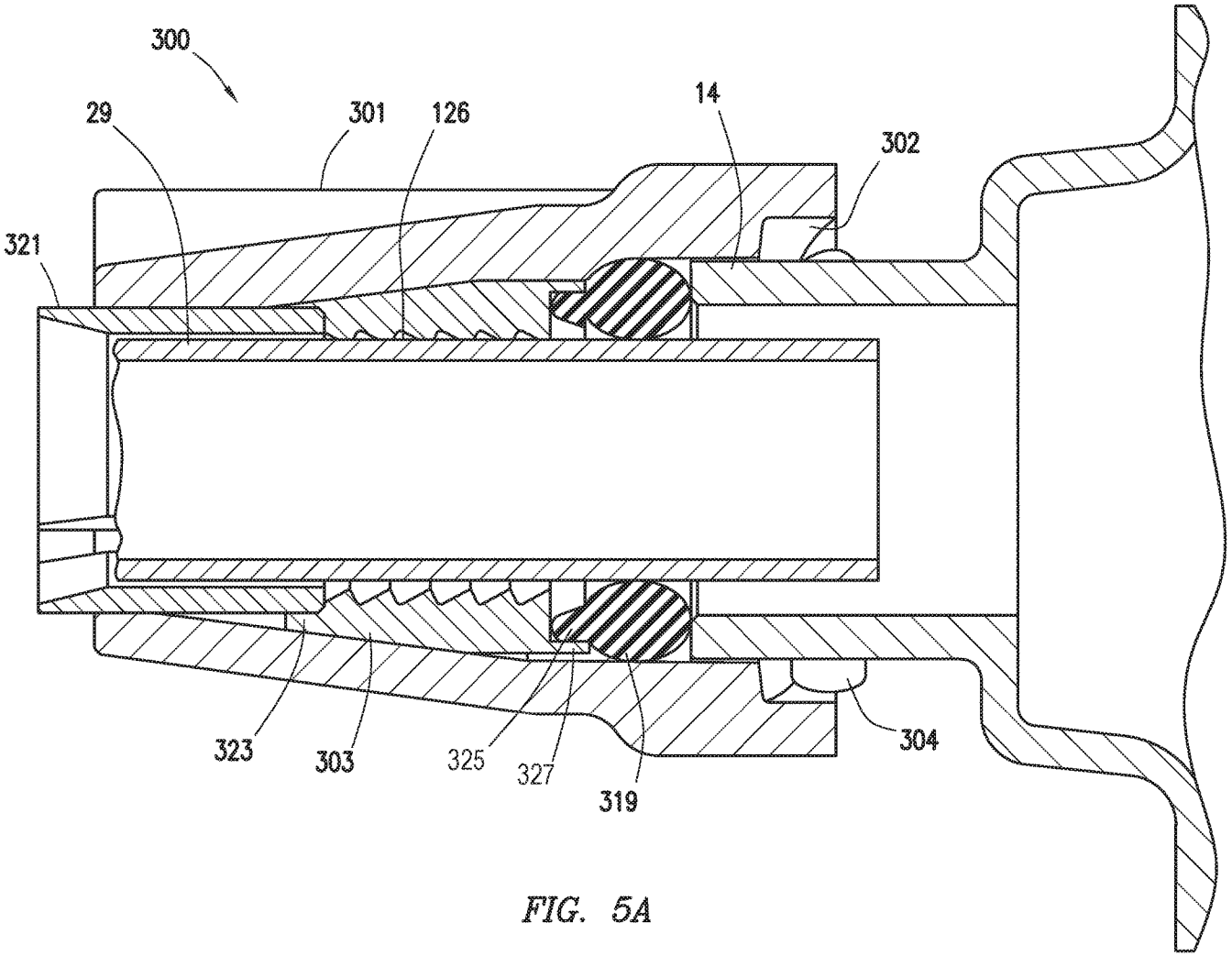
FIG. 5A depicts a partial cross section of an anchor for a post tensioned concrete member including a sheathing retention assembly consistent with at least one embodiment of the present disclosure.

In some embodiments, such as depicted in FIG. 2A, sheathing retention assembly 100 may include outer cap 101, one or more holding elements 103, and seal 119. Outer cap 101 may be tubular or generally tubular. Outer cap 101 may include a coupler for connecting to tubular extension 14 of stressing end anchor 17 through which tension member 15 may pass. Although described with respect to stressing end anchor 17, sheathing retention assembly 100 may be used in conjunction with fixed end anchor 13, as shown in FIG. 2B. In some embodiments, tubular extension 14 may be formed integrally with stressing end anchor 17. In some embodiments, tubular extension 14 may be formed separately from stressing end anchor 17 and may be coupled thereto by, for example and without limitation, a press fit, chemical or mechanical welding, a thread, detent, press lock, bayonet, or tab-and-slot connection. In some embodiments, tubular extension 14 may be coupled to outer cap 101 before tubular extension 14 is installed to stressing end anchor 17. In such an embodiment, outer cap 101 may be coupled in a non-actuated position when tubular extension 14 is coupled to outer cap 101. In the non-actuated position, holding elements are positioned within outer cap 101 and the wedges may slide along sheath 29. FIG. 5A depicts outer cap 101 in non-actuated position. Outer cap 101 may be moved into the actuated position by coupling to tubular extension 14 by a coupler, including for example and without limitation a thread, detent, press lock, bayonet, or tab-and-slot connection. In the actuated position, holding elements 103 may grip sheath 29, as described herein below. FIGS. 2A, 2B depict outer cap 101 in an actuated position. As depicted in FIG. 2A, 2B, the coupler is a tab-and-slot connection where outer cap 101 may include one or more slots 102 that may receive one or more corresponding tabs 104 formed on engaging surface 135 of tubular extension 14. In some embodiments, slots 102 may be wedge-shaped to allow installation of outer cap 101 about tubular extension 14 while inhibiting removal of extension 14 therefrom.

Figure 5B:
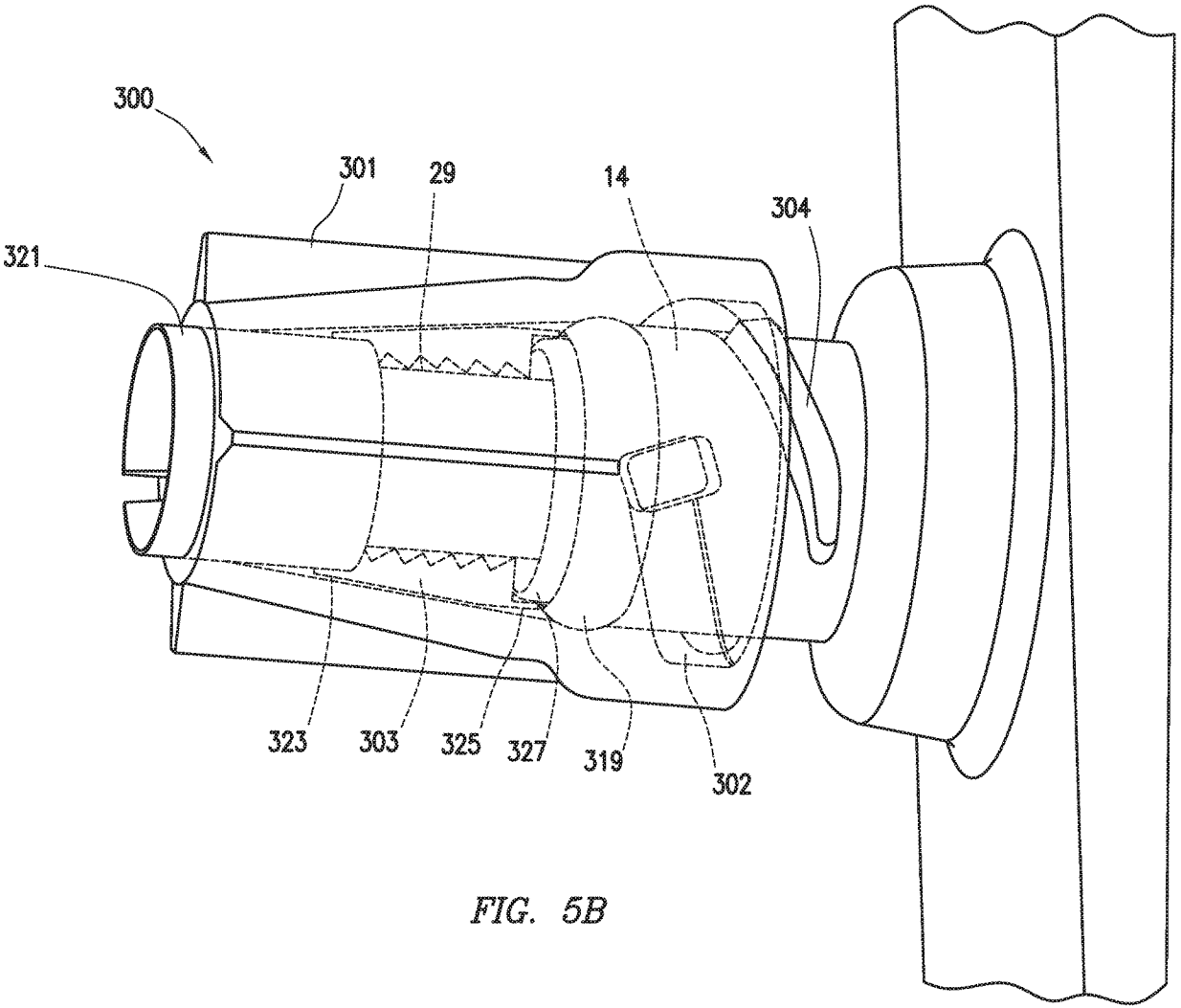
FIG. 5B is a partial transparent view of the anchor of FIG. 5A.

In another embodiment, as shown in FIG. 5B, outer cap 301 may include outer cap bayonet ramps 302. Outer cap bayonet ramps 302 may interconnect with corresponding tubular extension bayonet ramps 304 formed on tubular extension 14. Outer cap 101 may couple to tubular extension 14 through one or more intermediate components without deviating from the scope of this disclosure. In some embodiments, as depicted in FIG. 2, outer cap 101 may include a tapered inner surface defined herein as forcing surface 115.

One or more holding elements 103 may be positioned at least partially within outer cap 101. Holding elements 103 may be wedge shaped. In some embodiments, holding elements 103 may include tapered surfaces that collectively form tapered outer surface 117. Tapered outer surface 117 may abut and correspond with forcing surface 115. In other embodiments, holding elements 103 are not tapered, i.e., holding elements 103 have no tapered outer surface 117. Holding elements 103 may be spaced apart within sheathing retention assembly 100 or may be placed in abutment. Holding elements 103 may be positioned within sheathing retention assembly 100 such that tapered outer surface 117 abuts forcing surface 115. Forcing surface 115 and outer surface 117 of holding elements 103 may be positioned such that as outer cap 101 is installed in the actuated position onto tubular extension 14, the taper of forcing surface 115 and the taper of the outer surface 117 of holding elements 103 may serve to bias or push holding elements 103 inward into contact with sheath 29, thus, in some embodiments, increasing normal force between holding elements 103 and sheath 29.

Inner surfaces 120 of holding elements 103 may collectively form inner face 109. Inner face 109 may be continuous or discontinuous depending on the specific arrangement of holding elements 103. Inner face 109 may have inner face diameter 122 generally corresponding with, i.e., approximately equal to, outer diameter 124 of sheath 29. In some embodiments, holding elements 103 may include one or more surface features on inner face 109 that may increase the static friction between the outer surface 126 of sheath 29 and holding elements 103. In some embodiments, the surface features may include, for example and without limitation, teeth 111. Teeth 111 may be one or more grooves, protrusions, or ridges that contact outer surface 126 of sheath 29 and, in some embodiments, press into outer surface 126 of sheath 29, thus increasing the retention force between holding elements 103 and sheath 29.

In some embodiments, sheathing retention assembly 100 may also include seal 119. Seal 119 may be positioned to seal between sheath 29 and tubular extension 14 and may further be positioned between outer cap 101 and holding elements 103. Seal 119 may be annular or generally annular and fit into recess 128 formed between outer cap 101, tubular extension 14, and sheath 29. In some embodiments, seal 119 may be positioned such that as outer cap 101 is installed into the actuated position onto tubular extension 14, seal 119 is compressed between tubular extension 14, sheath 29, and outer cap 101. Seal 119 may protect tension member 15 from corrosion after concrete 23 (shown in FIG. 1B) is poured, such as by inhibiting fluid ingress into the interior of sheath 29. Additionally, seal 119 may inhibit concrete 23 from entering tension member 15. In some embodiments, seal 119 may form a press fit with outer cap 101. In some such embodiments, seal 119 may retain holding elements 103 within outer cap 101 prior to installation thereof.

Figure 3:
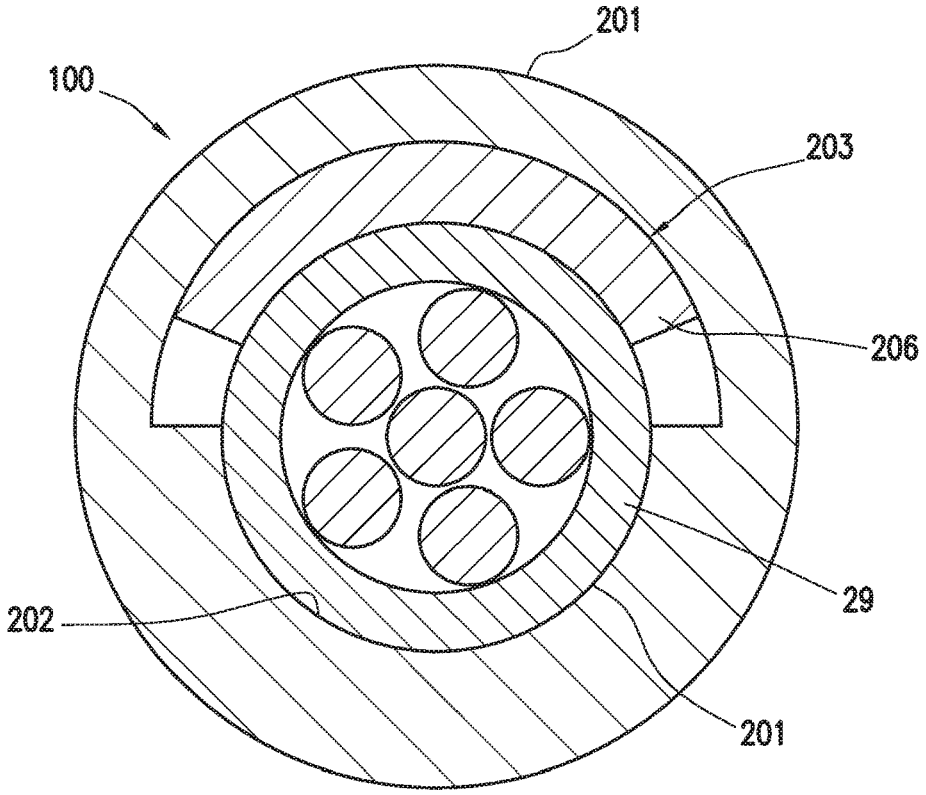
FIG. 3 depicts a cross section of a sheathing retention assembly consistent with at least one embodiment of the present disclosure.

In some embodiments, as depicted in FIG. 3, holding element 203 of sheathing retention assembly 200 may be positioned about only a portion of sheath 29. In some such embodiments, holding element 203 may be a single wedge 206. Wedge 206 may press against sheath 29 when compressed. In some embodiments, outer body 201 may include holding surface 202 positioned in opposition to wedge 206 to provide an opposing force on sheath 29 as wedge 206 engages sheath 29.

Figure 4A:
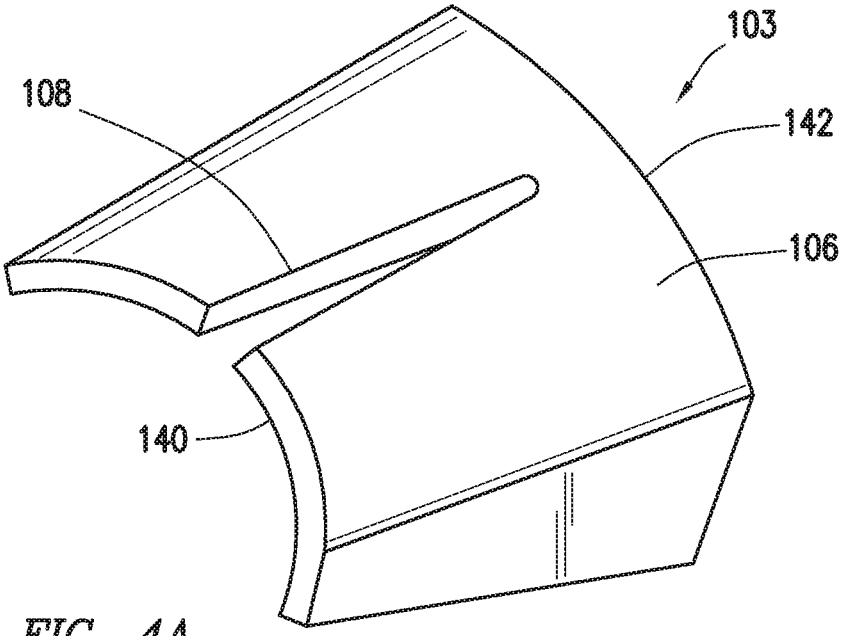
FIGS. 4A, 4B depict a wedge for use in a sheathing retention assembly consistent with at least one embodiment of the present disclosure.
Figure 4B:
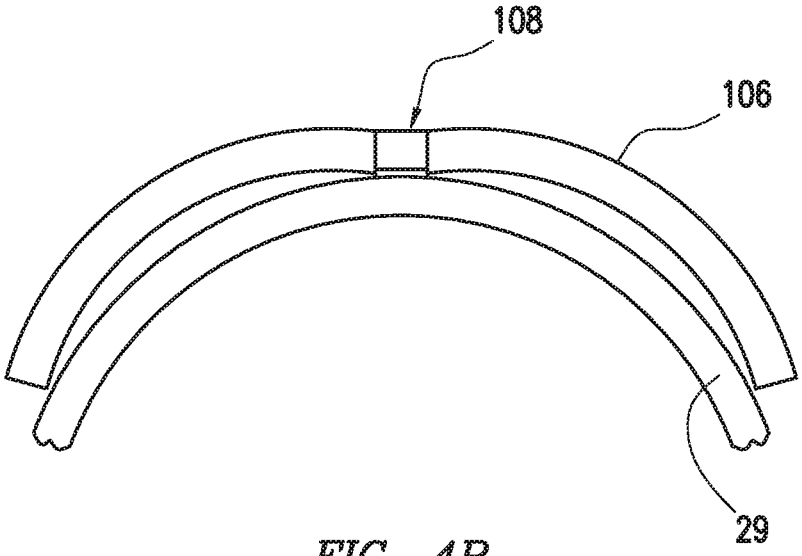

In some embodiments, one or more holding elements 103 may be formed as one or more wedges 106 as depicted in FIG. 4A. At least one wedge 106 may be arcuate. In some embodiments, wedges 106 may include partial split 108 to allow wedge 106 to flex as depicted in FIG. 4B when compressed. Partial split 108 may extend from first end 140 of wedge 106 but not to second end 142 of wedge 106. This flexure may allow for deformation of wedge 106, and increased contact of wedge 106 with sheath 29. In some embodiments, the inner diameter of wedge 106 may be less than outer diameter 124 of sheath 29 to allow for a friction fit or press fit. The inner diameter of wedge 106 is the inner diameter of wedge 106 were it to extend circumferentially. Split 108 may allow deformation of wedge 106 to allow the inner diameter of wedge 106 thereof to more closely match outer diameter 124 of sheath 29.

In some embodiments, as depicted in FIGS. 5A, 5B, sheathing retention assembly 300 may further include spacing collet 321. Spacing collet 321 may be positioned at least partially within outer cap 301. Spacing collet 321 may be tubular or generally tubular and may form a friction fit with the outer surface 126 of sheath 29. Spacing collet 321 may be positioned to fit within flanges 323 formed on holding elements 303. Spacing collet 321 may thus retain holding elements 303 in an open position while sheath 29 is installed into sheathing retention assembly 300, allowing sheath 29 to more easily move through holding elements 303 until outer cap 301 is installed to tubular extension 14. When outer cap 301 is installed to tubular extension 14, the movement of outer cap 301 may cause holding elements 303 to move such that front flanges 323 move past spacing collet 321, allowing holding elements 303 to extend inward and grip sheath 29. Additionally, the movement of holding elements 303 may compress seal 319 against tubular extension 14. In some embodiments, seal 319 may include spacing flange 325 adapted to fit into end flanges 327 formed on holding elements 303. Seal 319 may thus retain holding elements 303 in an open position until outer cap 301 is installed to tubular extension 14. Furthermore, inward movement of holding elements 303 may cause spacing flange 325 to contact outer surface 126 of sheath 29.

Figure 6:
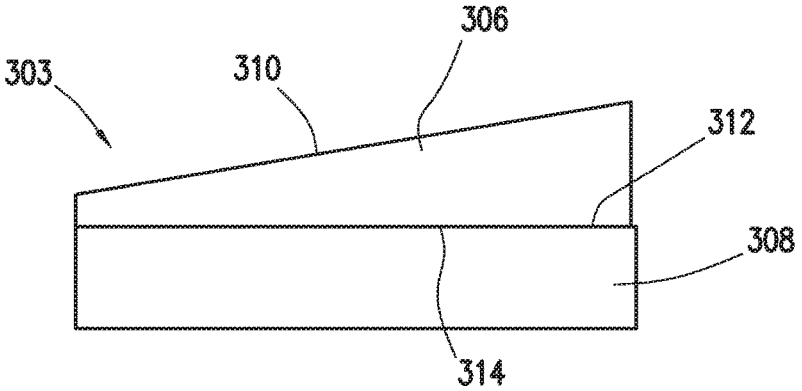
FIG. 6 depicts a wedge for use in a sheathing retention assembly consistent with at least one embodiment of the present disclosure.

In some embodiments, as depicted in FIG. 6, holding element 303 may be formed from a plurality of pieces. In some embodiments, holding element 303 may include wedged piece 306 and die face piece 308. Wedged piece 306 may have tapered outer surface 310 and flat inner surface 312, where outer surface 314 of die face piece 308 may be flat. In some embodiments, wedged piece 306 may be bonded to die face piece 308.

In operation, sheath retention assembly 100 may be coupled to fixed end anchor 13 before fixed end anchor 13 is positioned within concrete form 21 as depicted in FIG. 1A when tension member 15 is preinstalled into fixed end anchor 13. A second sheathing retention assembly 100 may be positioned about tension member 15 before tension member 15 is passed through stressing end anchor 17. Tension member 15 may be passed through stressing end anchor 17. Outer cap 101 may be coupled to tubular extension 14 of stressing end anchor 17, causing holding elements 103 to engage outer surface 126 of sheath 29, retaining sheath 29 to stressing end anchor 17. In some embodiments, if included, seal 119 may also seal between at least outer surface 126 of sheath 29 and tubular extension 14. Contraction of sheath 29 may allow holding elements 103 to engage forcing surface 115, increasing the normal force between holding elements 103 and sheath 29, thus increasing the friction therebetween.

One having ordinary skill in the art with the benefit of this disclosure will understand that although described specifically with respect to fixed end anchor 13 and stressing end anchor 17, sheathing retention assembly 100 may be utilized with any anchor for a post-tensioned concrete member including a fixed end anchor or stressing end anchor. Furthermore, sheathing retention assembly 100 may be used with an intermediate anchor as understood in the art.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure. Unless explicitly stated otherwise, nothing herein is intended to be a definition of any word or term as generally used by a person of ordinary skill in the art, and nothing herein is a disavowal of any scope of any word or term as generally used by a person of ordinary skill in the art.

What is claimed is:

1. A post-tensioning tendon comprising:

a tension member including a strand and a sheath, the sheath having an outer surface;

an anchor coupled to an end of the tension member, the anchor including a tubular extension through which the tension member is passed; and a sheathing retention assembly including:

an outer cap, the outer cap having an inner forcing surface, the outer cap coupled to the tubular extension; and one or more sheath holding elements positioned at least partially within the outer cap, the one or more sheath holding elements each having a tapered outer surface engaging the forcing surface, the one or more sheath holding elements each including an inner surface that engages the outer surface of the sheath, wherein engagement of the tapered outer surface with the forcing surface biases the sheath holding elements radially inward into contact with the sheath thereby increasing normal force between the holding elements and the sheath and causing the sheath holding elements to grip the sheath; and a seal positioned between the outer surface of the sheath and the outer cap.

2. A post-tensioning tendon comprising:

a tension member including a strand and a sheath, the sheath having an outer surface;

an anchor coupled to an end of the tension member by wedges, the anchor including a tubular extension through which the tension member is passed; and a sheathing retention assembly including:

an outer cap, the outer cap having an inner forcing surface, the outer cap coupled to the tubular extension; and one or more sheath holding elements positioned at least partially within the outer cap, the one or more sheath holding elements each having a tapered outer surface engaging the forcing surface, the one or more sheath holding elements each including an inner surface that engages the outer surface of the sheath, wherein engagement of the tapered outer surface with the forcing surface biases holding elements radially inward into contact with the sheath thereby increasing normal force between the holding elements and the sheath and causing the holding elements to grip the sheath; and a seal positioned between the outer surface of the sheath and the outer cap;

wherein the seal is positioned between the outer surface of the sheath and both the outer cap and the one or more sheath holding elements and is also positioned between the one or more sheath holding elements and the tubular extension.

3. The post-tensioning tendon of claim 2 wherein engagement of the tapered outer surface of each sheath holding element with the forcing surface causes sheath holding elements to compress the seal against the tubular extension.

4. A post-tensioning tendon comprising:

a tension member including a strand and a sheath, the sheath having an outer surface;

an anchor coupled to an end of the tension member, the anchor including a tubular extension through which the tension member is passed; and a sheathing retention assembly including:

an outer cap, the outer cap having an inner forcing surface, the outer cap coupled to the tubular extension;

one or more sheath holding elements positioned at least partially within the outer cap, the one or more sheath holding elements each having a tapered outer surface engaging the forcing surface, the one or more sheath holding elements each including an inner surface that engages the outer surface of the sheath, wherein engagement of the tapered outer surface with the forcing surface biases holding elements radially inward into contact with the sheath thereby increasing normal force between the holding elements and the sheath and causing the holding elements to grip the sheath; and a seal positioned between the outer cap and the outer surface of the sheath and positioned between the one or more sheath holding elements and the tubular extension;

wherein each sheath holding element includes an end flange extending toward the tubular extension and the seal includes a spacing flange adapted to fit between the end flanges and the sheath.

5. A post-tensioning tendon comprising:

a tension member including a strand and a sheath, the sheath having an outer surface;

an anchor coupled to an end of the tension member, the anchor including a tubular extension through which the tension member is passed; and a sheathing retention assembly including:

an outer cap, the outer cap having an inner forcing surface, the outer cap coupled to the tubular extension;

one or more sheath holding elements positioned at least partially within the outer cap, the one or more sheath holding elements each having a tapered outer surface engaging the forcing surface, the one or more sheath holding elements each including an inner surface that engages the outer surface of the sheath, wherein engagement of the tapered outer surface with the forcing surface biases holding elements radially inward into contact with the sheath thereby increasing normal force between the holding elements and the sheath and causing the holding elements to grip the sheath; and a seal positioned between the outer cap and the outer surface of the sheath and positioned between the one or more sheath holding elements and the tubular extension, the seal including a spacing flange adapted to fit between the sheath holding elements and the sheath;

wherein engagement of the tapered outer surface of each sheath holding element with the forcing surface causes sheath holding elements to compress the seal against the tubular extension; and wherein the seal retains the sheath holding elements in an open position until the outer cap is installed to the tubular extension; and wherein engagement of the sheath holding elements with the forcing surface biases holding elements radially inward and causes the spacing flange to contact the sheath.

6. The post-tensioning tendon of claim 1 having a plurality of sheath holding elements, wherein the inner surfaces of the plurality of sheath holding elements form an inner face.

7. The post-tensioning tendon of claim 6 wherein the inner face has teeth, wherein the teeth of the inner face contact the outer surface of the sheath.

8. The post-tensioning tendon of claim 1 wherein the outer cap couples to the tubular extension by a coupler selected from the group consisting of a threaded, detent, press lock, bayonet, or tab-and-slot coupler.

9. The post-tensioning tendon of claim 8 wherein the tubular extension has an engaging surface, and wherein the coupler is a tab-and-slot coupler, wherein the tab-and-slot coupler comprises:

one or more slots formed in the outer cap; and one or more tabs formed on an engaging surface of the tubular extension, wherein the one or more slots receive the one or more tabs.

10. The post-tensioning tendon of claim 8 wherein the coupler is a bayonet coupler, wherein the bayonet coupler comprises:

one or more outer cap bayonet ramps positioned on the outer cap; and one or more tubular extension ramps positioned on the tubular extension, wherein the outer cap bayonet ramps interconnect with the one or more tubular extension bayonet ramps.

11. The post-tensioning tendon of claim 1 wherein the one or more sheath holding elements are arcuate wedges.

12. The post-tensioning tendon of claim 11 wherein the arcuate wedges each include a partial split.

13. The post-tensioning tendon of claim 4 having a plurality of sheath holding elements, wherein the inner surfaces of the plurality of sheath holding elements form an inner face and wherein the inner face has teeth.

14. The post-tensioning tendon of claim 4 wherein the outer cap couples to the tubular extension by a coupler selected from the group consisting of a threaded, detent, press lock, bayonet, or tab-and-slot coupler.

15. The post-tensioning tendon of claim 14 wherein the tubular extension has an engaging surface, wherein the coupler is a tab-and-slot coupler, and wherein the tab-and-slot coupler comprises:

one or more slots formed in the outer cap; and one or more tabs formed on an engaging surface of the tubular extension, wherein the one or more slots receive the one or more tabs.

16. The post-tensioning tendon of claim 14 wherein the coupler is a bayonet coupler, wherein the bayonet coupler comprises:

one or more outer cap bayonet ramps positioned on the outer cap; and one or more tubular extension ramps positioned on the tubular extension, wherein the outer cap bayonet ramps interconnect with the one or more tubular extension bayonet ramps.

17. The post-tensioning tendon of claim 4 wherein the one or more sheath holding elements are arcuate wedges.

18. The post-tensioning tendon of claim 17 wherein the arcuate wedges each include a partial split.

19. The post-tensioning tendon of claim 5 having a plurality of sheath holding elements, wherein the inner surfaces of the plurality of sheath holding elements form an inner face and wherein the inner face has teeth.

20. The post-tensioning tendon of claim 5 wherein the outer cap couples to the tubular extension by a coupler selected from the group consisting of a threaded, detent, press lock, bayonet, or tab-and-slot coupler.

21. The post-tensioning tendon of claim 20 wherein the tubular extension has an engaging surface, wherein the coupler is a tab-and-slot coupler, and wherein the tab-and-slot coupler comprises:

one or more slots formed in the outer cap; and one or more tabs formed on an engaging surface of the tubular extension, wherein the one or more slots receive the one or more tabs.

22. The post-tensioning tendon of claim 20 wherein the coupler is a bayonet coupler, wherein the bayonet coupler comprises:

one or more outer cap bayonet ramps positioned on the outer cap; and one or more tubular extension ramps positioned on the tubular extension, wherein the outer cap bayonet ramps interconnect with the one or more tubular extension bayonet ramps.

23. The post-tensioning tendon of claim 5 wherein the one or more sheath holding elements are arcuate wedges.

24. The post-tensioning tendon of claim 23 wherein the arcuate wedges each include a partial split.

* * * * *